US006318617B1

(12) United States Patent
Cheng

(10) Patent No.: US 6,318,617 B1
(45) Date of Patent: Nov. 20, 2001

(54) BOX NAILING MACHINE WITH A POSITION-ADJUSTABLE NAIL STOPPER

(76) Inventor: Cheng-Tsung Cheng, No. 110, Yi Hsin 2nd Road, Tai-Ping City, Taichung Hsien (TW)

( * ) Notice: Subject to any disclaimer, the term of this patent is extended or adjusted under 35 U.S.C. 154(b) by 0 days.

(21) Appl. No.: 09/842,726

(22) Filed: Apr. 27, 2001

(51) Int. Cl.[7] ..... B25C 1/04
(52) U.S. Cl. ..... 227/109; 227/123; 227/127
(58) Field of Search ..... 227/109, 120, 227/123, 127, 119

(56) References Cited

U.S. PATENT DOCUMENTS 4,467,952 * 8/1984 Morrell, Jr. ..... 227/123
4,549,681 * 10/1985 Yamamoto et al. ..... 227/123
4,688,710 * 8/1987 Massari, Jr. et al. ..... 227/109
5,238,168 * 8/1993 Oda ..... 227/123
5,649,660 * 7/1997 Akiba et al. ..... 227/123
5,873,509 * 2/1999 Liao ..... 227/109
6,076,720 * 6/2000 Deng ..... 227/109

* cited by examiner

*Primary Examiner*—Scott A. Smith
(74) *Attorney, Agent, or Firm*—Rosenberg, Klein & Lee

(57) ABSTRACT

A box nailing machine is disclosed. In the box nailing machine, A seat has an inner space. A base is installed below the seat. A nail stopper is installed above the base in the inner space of the seat and being confined by the inner space to move up and down. A nail receiving space is positioned between the nail stopper and the base in the seat; and an adjustable stud is passed through the seat and nail stopper. Thereby as the adjustable stud is rotated, the nail stopper is driven to be moved up and down for changing a volume of the nail receiving space.

5 Claims, 7 Drawing Sheets

BOX NAILING MACHINE WITH A POSITION-ADJUSTABLE NAIL STOPPER

FIELD OF THE INVENTION

The present invention relates to a box nailing machine, and especially to a box nailing machine with an adjustable nail stopper for receiving nails of different thickness.

BACKGROUND OF THE INVENTION

Referring to FIG. 7, a prior nail is illustrated. In that, the stop plate 91, guide plate 93 and nail recess 92 are fixed together. The depth of the moving groove 94 is also fixed. Therefore, the box nailing machine only jets nails of fixing thickness. If nails of different thickness are to be used, the whole nail cartridge 9 must be updated, however, this is time and labor-consumed. Therefore, it is necessary to have a novel box nailing machine which may jet nails of different thickness without needing to update nail cartridge.

SUMMARY OF THE INVENTION

A box nailing machine is disclosed. In the box nailing machine, A seat has an inner space. A base is installed below the seat. A nail stopper is installed above the base in the inner space of the seat and being confined by the inner space to move up and down. A nail receiving space is positioned between the nail stopper and the base in the seat; and an adjustable stud is passed through the seat and nail stopper. Thereby as the adjustable stud is rotated, the nail stopper is driven to be moved up and down for changing a volume of the nail receiving space.

The various objects and advantages of the present invention will be more readily understood from the following detailed description when read in conjunction with the appended drawing.

DETAILED DESCRIPTION OF THE PREFERRED EMBODIMENTS

Figure 1:
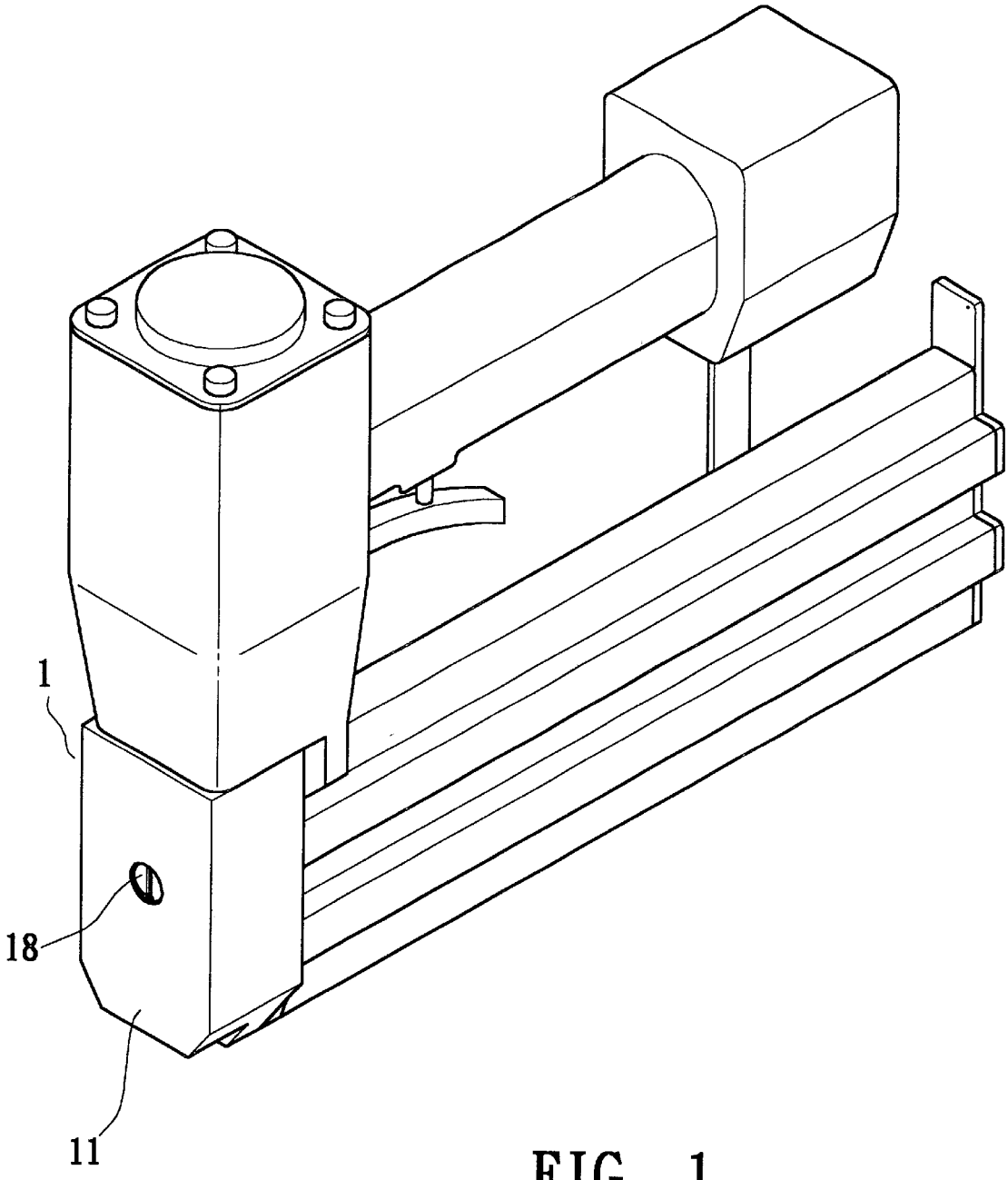
FIG. 1 is a perspective view of the present invention.
Figure 2:
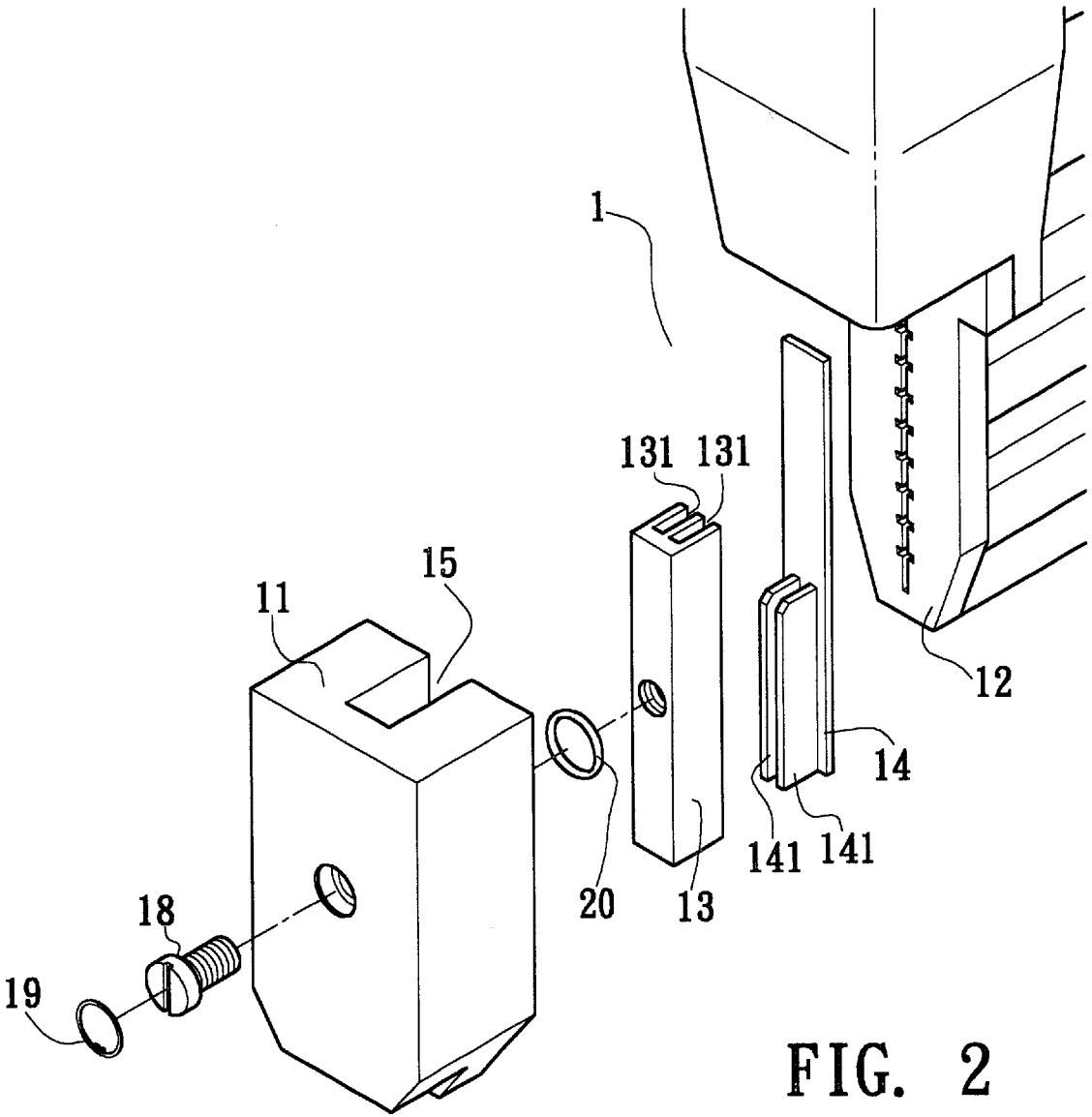
FIG. 2 is an exploded perspective view of the present invention.
Figure 3:
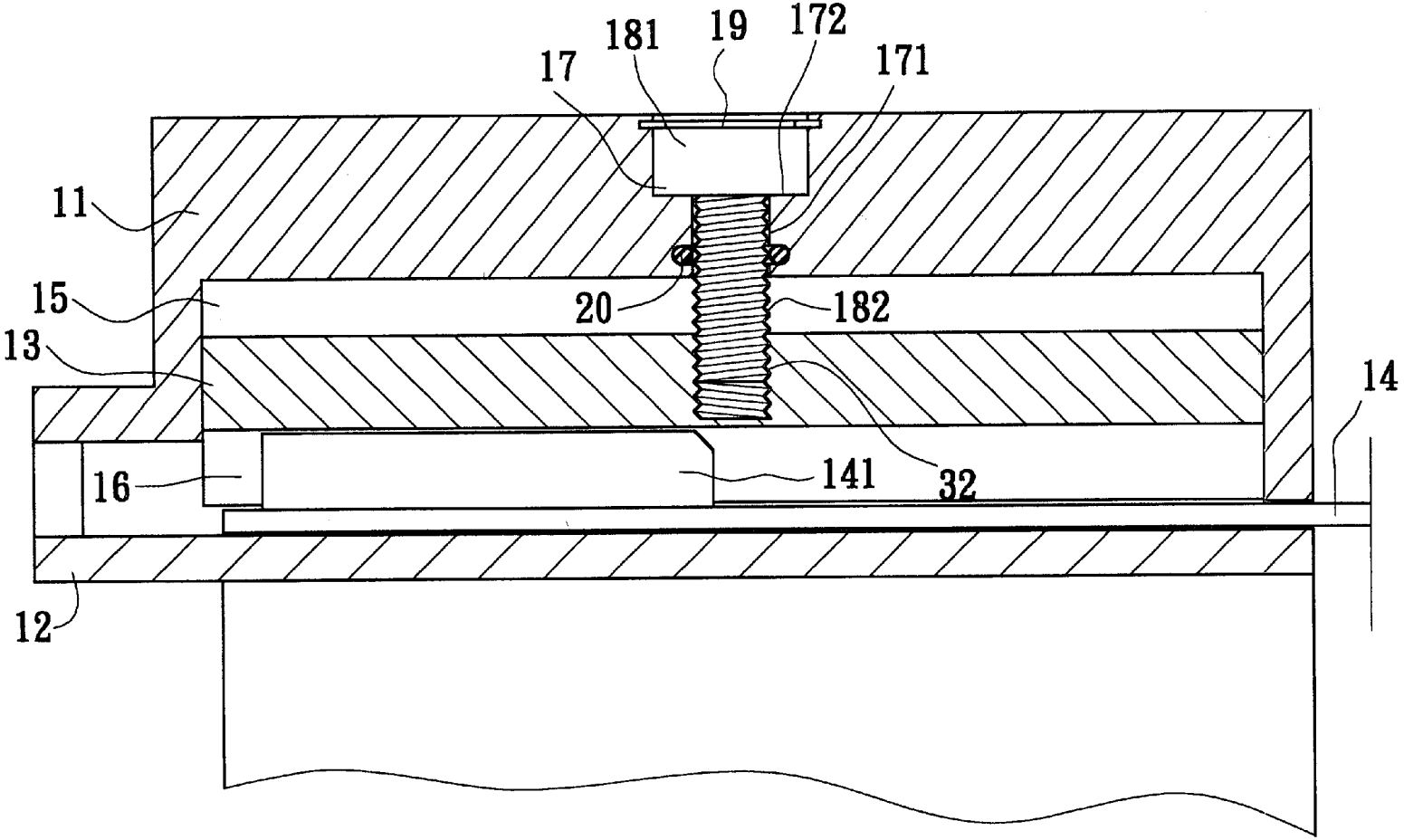
FIG. 3 is a cross sectional view of FIG. 1.

Referring to FIGS. 1 to 6, the box nailing machine of the present invention is illustrated. As shown in the FIGS. 1 to 3, the box nailing machine 1 of the present invention comprises a seat 11 having an inner space 15 and a base 12 installed below the seat 11. The inner space 15 of the seat 11 has a nail stopper 13 which is position-adjustable. This nail stopper 13 is confined by the inner space 15 so as just to move upwards or downwards. A nail receiving space 16 is formed between the nail stopper 13 and the base 12. Further, an adjustable stud 18 passing through the seat 11 and the nail stopper 13 are formed therebetween. Besides, the box nailing machine of the present invention provides a nail beating piece 14 for pushing the nail to be jetted out. Referring to FIGS. 1 to 3, since the "M" shape cross section of the nail stopper 13, two recesses 131, 131' are generated, while the nail beating piece 14 has two protrusions 141, 141' so that they may move in the two recesses 131, 131' forwards and backwards to beat the nail. As known by those skilled in the art, the nail stopper 13 and nail beating piece 14 are not confined to the configurations illustrated in the figures, any device which may cause the nail beating piece 14 to move in the nail stopper 13 linearly serves this purpose. The top of the seat 11 and top of the nail stopper 13 have a T shape groove 17 and a screw hole 132, respectively. The T shape groove 17 and screw hole 132 are communicated for installing the adjustable stud 18. The T shape groove 17 includes at least an upper portion and a lower portion. The diameter of the upper portion is larger than the lower portion so that a platform surface 172 is formed at the boundary of the upper portion and the lower portion. The periphery of the upper portion has an inner concave groove for installing a C ring 19. A depth of the concave groove is larger than the thickness of the C ring 19 so that the one part of the C ring 19 protrudes from the peripheral wall of the T shape groove 17 so as to stop the adjustable stud 18 in the T shape groove 17. The lower portion is a though hole 171.

The upper wall of the inner space 15 of the seat 11 has an upper surface installed with a soft rubber 20. The soft rubber 20 is concentric with the though hole 171 and is positioned at the periphery of the though hole 171. The inner diameter of the soft rubber 20 is smaller than the adjustable stud 18 and is elastic, thereby preventing the looseness of the stud 18 passing therethrough. When the adjustable stud 18 is inserted into the T shape groove 17, the thread 182 of the adjustable stud 18 passes through the though hole 171 and the soft rubber 20 to screw into the screw hole 132 on the nail stopper 13. Since the upper side of the adjustable stud 18 is stopped by the C ring 19, it only rotates instead of rising upwards. Therefore, when the adjustable stud 18 is rotated, the nail stopper 13 will move upwards or downwards along the rotating direction of the adjustable stud 18. When the adjustable stud 18 causes the nail stopper 13 to move upwards, the depth of the nail receiving space 16 of the seat 11 will increase, thereby receiving thicker nails. When the adjustable stud 18 is rotated so that the nail stopper 13 moves downwards, the depth of the nail receiving space 16 will increase so as to receive smaller nails. Therefore, as it is desired to use nails of different thickness, it is only necessary to rotate the adjustable stud 18.

Figure 4:
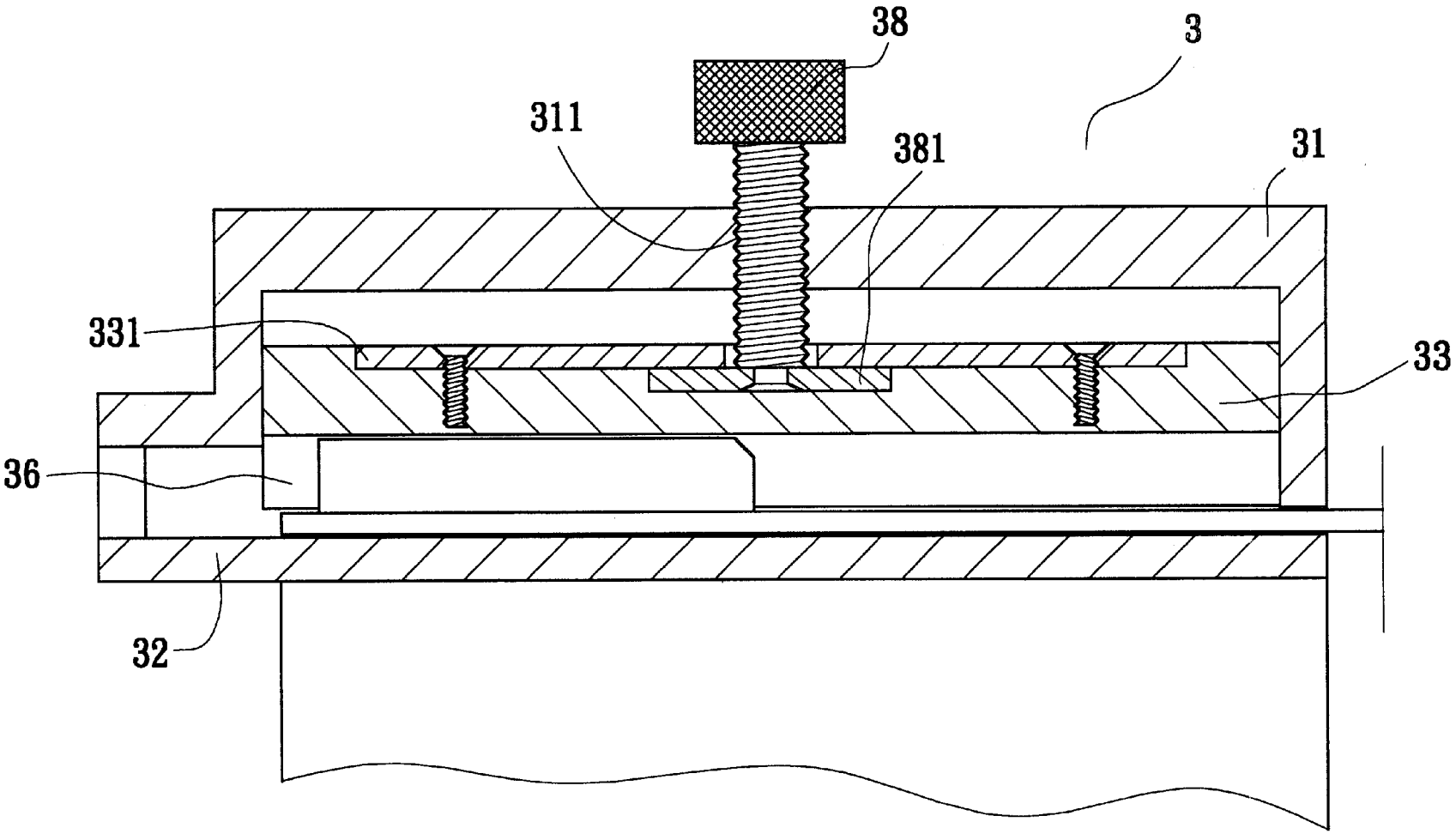
FIG. 4 is a cross sectional view of the second embodiment in the present invention.

Of course, many examples are suitable in the present invention, which is only slightly modified. Referring to FIG. 4, the second embodiment of the box nailing machine according to the present invention is illustrated. The top of the seat 31 of this box nailing machine 3 is installed with a screw hole 311 for screwing a stud 38. The top of the nail stopper 33 is installed with a retaining piece 331. The retaining piece 331 clamps a stopper 381 riveted to the stopper 381 in front of the stud 38. Thereby, when the stud 38 is rotated, the nail stopper 33 also moves upwards and downwards so that the size of the nail receiving space 16 below the nail stopper 33 will change so as to present the function of the first embodiment.

Figure 5:
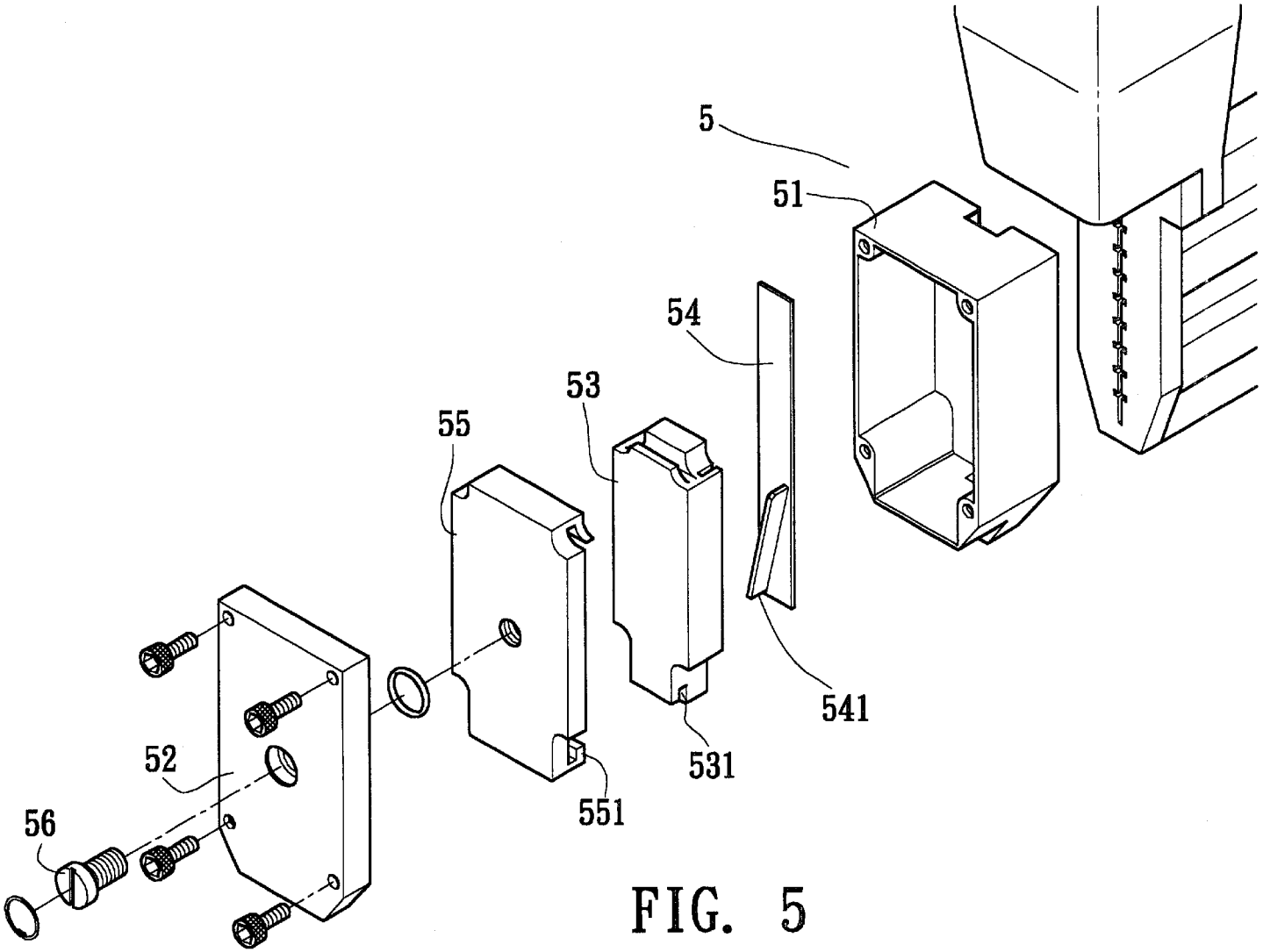
FIG. 5 is an exploded perspective view of the third embodiment in the present invention.
Figure 6:
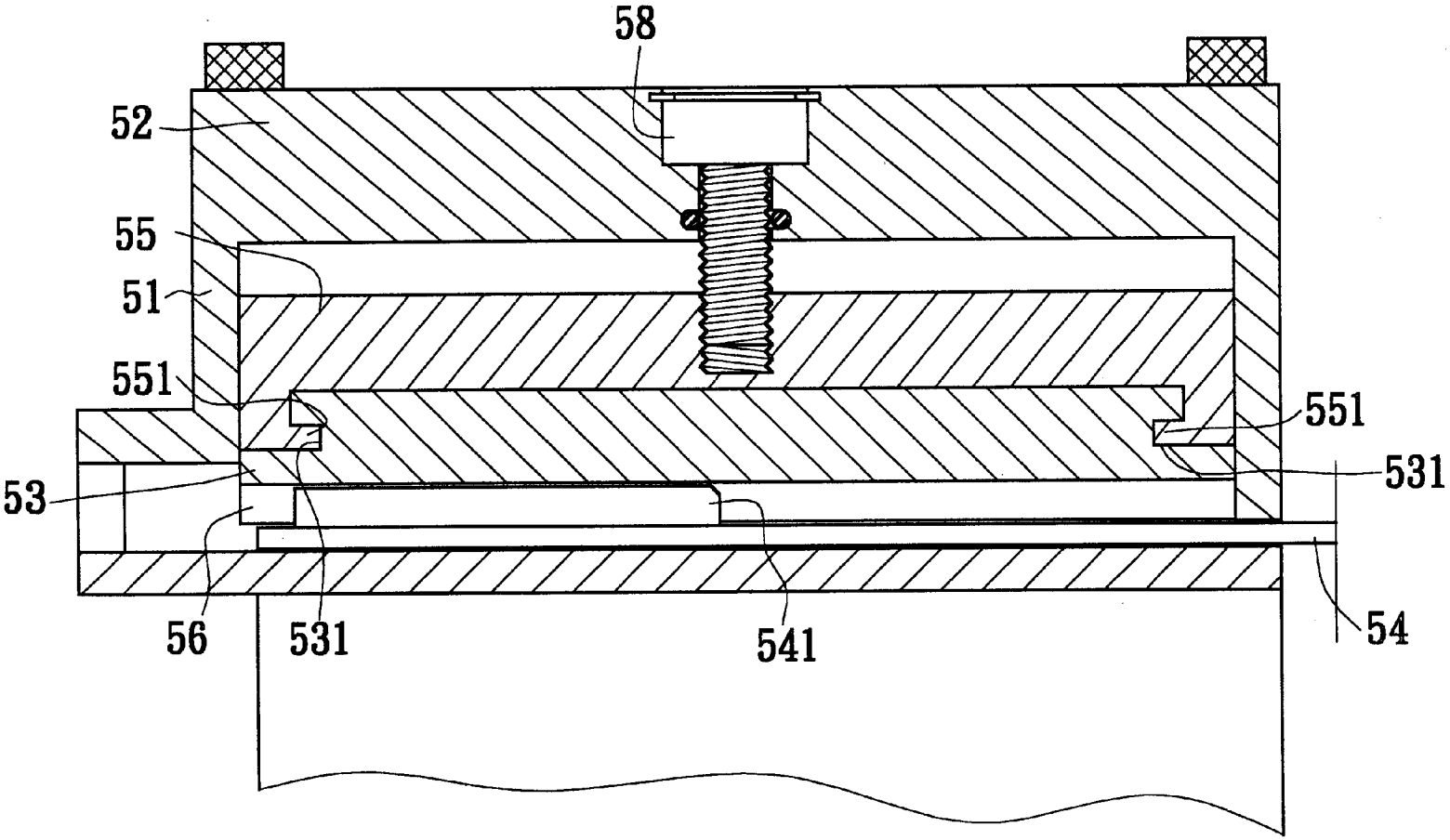
FIG. 6 is a cross sectional view of the third embodiment in the present invention.
Figure 7:
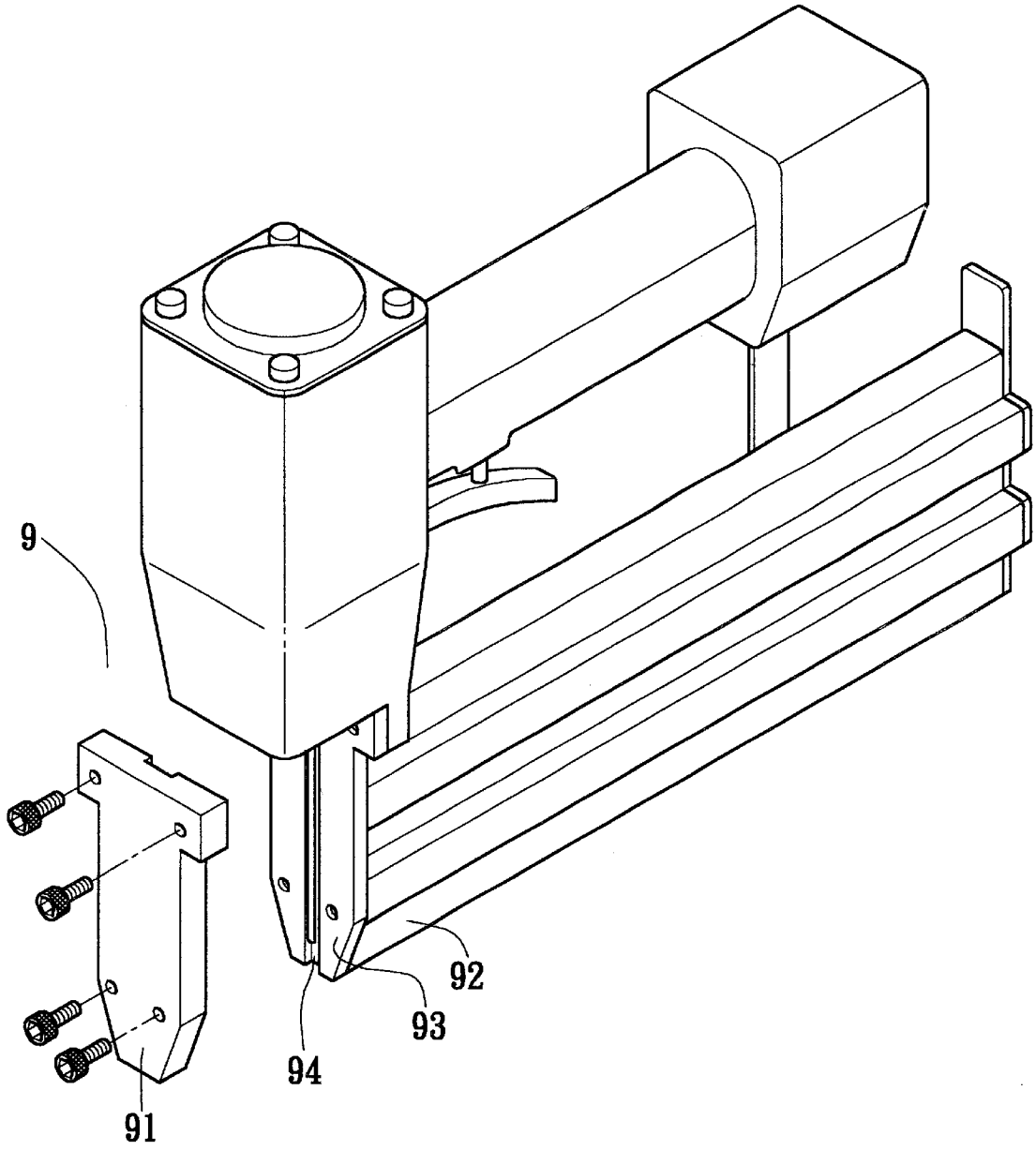
PRIOR ART FIG. 7
FIG. 7 is an exploded perspective view of the prior box nailing machine.

Further, a third embodiment of the present invention is provided. With reference to FIGS. 5 and 6, the box nailing machine includes a hollow seat 51 and an upper plate 52 covering the seat 51, the stopper plate 55 is installed in the seat 51. A nail stopper 53 is positioned below the stopper plate 55 and is confined by the stopper plate 55 so as not to move up and down. A nail receiving space 56 is formed below the nail stopper 53. A stud 58 passes through the upper plate 52 and the stopper plate 55. Furthermore, the box nailing machine 5 of the present invention provides a nail beating piece 54 for pushing the nail to be jetted out. As shown in the figure, since the front and rear sides of the nail stopper have protrusions concave inwards, while the front and rear sides of the nail stopper 52 have groove 531 concave inwards so that the protrusions 551 is conformed to the groove 531 of the nail stopper 53. Moreover, the interior of the nail stopper 53 has a tilt groove 532 tilt from the front side to the backside. The groove 532 is suitable for T shape or U shape nails and serves to prevent the nail from buckling into the groove. The nail beating piece 54 has a tilt protrusion parallel to the tilt groove 532 so that the nail beating piece 54 may move in the groove 532. Since the protrusion 541 of the nail beating piece 54 is tilt toward the groove of the nail stopper 53, when the nail beating piece 54 moves forwards, the nail stopper 53 will move rightwards and leftwards.

The upper plate 52 and stopper plate 55 have T shape groove and screw hole, respectively and have soft rubber concentric with the screw hole for installing the stud 58. The installing way is identical to the first embodiment. When the stud 58 rotates, the stopper plate 55 will move up and down along the rotation of the stud 58. As a result, the nail stopper 53 will move up and down so as to change the depth of the nail receiving space 56. Consequently, nails of different thickness can be used.

The present invention are thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A box nailing machine with an adjustable nail stopper comprising:

a seat having an inner space;

a base installed below said seat;

a nail stopper installed above said base in said inner space of said seat and being confined by said inner space to move up and down;

a nail receiving space positioned between said nail stopper and said base in said seat; and an adjustable stud passing through said seat and said nail stopper; thereby as said adjustable stud is rotated, said nail stopper being driven to be moved up and down for changing a volume of said nail receiving space.

2. The box nailing machine with an adjustable nail stopper as claimed in claim 1, wherein said seat has a T shape groove and said nail stopper has a screw hole for being passed by said adjustable stud.

3. A box nailing machine with an adjustable nail stopper, comprising:

a seat having an inner space and a top of said seat having a screw hole for being passed by a stud;

a base installed below said seat;

a nail stopper having a top installed with a retaining piece and installed above said base within said seat and being confined by said inner space to move up and down;

a nail receiving space positioned between said nail stopper and formed base in said seat; and an adjustable stud passing through said screw hole of said seat; and a front end of said adjustable stud being riveted to a stop piece, wherein said stop piece is clamped for retaining.

4. A box nailing machine with an adjustable nail stopper, comprising:

a seat having an opened top and bottom to be formed with an inner space;

an upper plate covering on said top;

a stopper plate installed within said seat;

a nail stopper installed at a bottom of said stopper plate, a front and a rear side of said nail stopper being coupled to a front and a rear side of said stopper plate so that said nail stopper is movable with respect to said stopper plate;

a nail receiving space positioned below said nail stopper within said seat; and an adjustable stud passing between said upper plate and nail stopper; thereby as said adjustable stud is rotated, said nail stopper is driven to be moved up and down for changing a volume of said nail receiving space.

5. The box nailing machine with an adjustable nail stopper, as claimed in claim 4, wherein said upper plate has a T shape groove and said nail stopper has a screw hole for being passing by said adjustable stud.

* * * * *